US012601555B2

(12) United States Patent
Ivgi

(10) Patent No.: US 12,601,555 B2
(45) Date of Patent: Apr. 14, 2026

(54) RETAINING MAGAZINE IN MAGAZINE WELL

(71) Applicant: Orpaz Defense Ltd., Rosh HaAyin (IL)

(72) Inventor: Simon Ivgi, Herzliya (IL)

(73) Assignee: Orpaz Defense Ltd., Rosh HaAyin (IL)

( * ) Notice: Subject to any disclaimer, the term of this patent is extended or adjusted under 35 U.S.C. 154(b) by 126 days.

(21) Appl. No.: 18/653,035

(22) Filed: May 2, 2024

(65) Prior Publication Data

US 2026/0016251 A1 Jan. 15, 2026

(51) Int. Cl.
*F41A 17/38* (2006.01)

(52) U.S. Cl.
CPC ..... *F41A 17/38* (2013.01)

(58) Field of Classification Search
CPC ..... F41A 17/38
USPC ..... 42/70.02
See application file for complete search history.

(56) References Cited

U.S. PATENT DOCUMENTS 684,055 A * 10/1901 Gabbet-Fairfax ..... F41A 3/64 89/196
972,087 A * 10/1910 Sunngard ..... F41A 17/38 42/7
5,159,136 A * 10/1992 Marsh ..... F41C 23/22 42/71.01
6,874,266 B1 * 4/2005 Kong ..... F41C 23/22 89/34
9,927,208 B2 * 3/2018 Petersen ..... F42B 39/02
10,041,759 B2 8/2018 Faifer
11,852,429 B1 * 12/2023 Dwyer ..... F41A 9/61
2012/0174453 A1 7/2012 Kallio
2019/0212085 A1 * 7/2019 Wilkinson ..... F41A 17/38
2023/0053485 A1 * 2/2023 Schoenfeld ..... F41A 9/67

FOREIGN PATENT DOCUMENTS

DE 3035796 C2 * 11/1989 ..... F41A 17/36

* cited by examiner

*Primary Examiner* — Bret Hayes
(74) *Attorney, Agent, or Firm* — Dekel Patent Ltd.; David Klein

(57) ABSTRACT

A magazine retention device includes a housing having a front surface and a back surface, a firearm attachment member for securing the magazine retention device to a portion of a firearm, a movable stop lever which includes a tab extending from a base member, the base member including an abutment face, and a pushing member which is urged against the abutment face by a biasing device. The movable stop lever has a locked position, in which the pushing member presses against the abutment face, which causes a portion of the movable stop lever to be pressed against a portion of the housing, such that the movable stop lever is sandwiched between the pushing member and the housing.

9 Claims, 4 Drawing Sheets

RETAINING MAGAZINE IN MAGAZINE WELL

FIELD OF THE INVENTION

The present invention relates to firearms and particularly to a device for retaining a magazine in a magazine well of the firearm.

BACKGROUND OF THE INVENTION

Many firearms, such as handguns and rifles, use a magazine to feed cartridges into the chamber of the firearm. Cartridges are loaded into the magazine and the magazine is inserted in the magazine well of the firearm. A magazine spring pushes the cartridges to the chamber. When the magazine is spent, a magazine release catch, usually located at the top of the magazine well, can be pressed to release the magazine.

There have been many instances of magazines falling out of the magazine well. Different possible causes include accidental pressing of the magazine release catch, bad tolerances causing the slide of the firearm to hit the magazine and force it out when the slide cycles, worn lips of the magazine so that the magazine is not held properly in the firearm.

SUMMARY

The present invention seeks to provide a device for retaining a magazine in a magazine well of a firearm, such as a handgun or rifle, as is described more in detail hereinbelow.

The device of the invention can be used while on duty or during every day carry (EDC), even while performing duty-related activities such as rappelling, climbing and running. The invention prevents the magazine from accidentally dropping out of the magazine well and can in certain situations prevent a misfeed. After installing the device of the invention, the user inserts the magazine in the magazine well as usual, and then moves (such as rotates) a movable stop lever of the device to be positioned below and against the floor plate of the magazine, and be locked in place. In this locked position, even if the magazine release catch is pressed, no amount of shaking will drop the magazine out. In order to release the magazine, the user depresses the magazine release catch, grasps the bottom of the magazine and simply pulls the magazine out. The act of pulling out the magazine, with the magazine release catch depressed, moves (such as rotates) the movable stop lever to an open position.

The device may be provided with an optional security ring for attaching a lanyard. This security ring may be used instead of the standard lanyard hole in handguns.

There is thus provided in accordance with a non-limiting embodiment of the invention a magazine retention device including a housing having a front surface and a back surface, a firearm attachment member for securing the magazine retention device to a portion of a firearm, a movable stop lever (which, for example, pivots about a pivot), the movable stop lever including a tab extending from a base member, the base member including an abutment face, and a pushing member which is urged against the abutment face by a biasing device, wherein the movable stop lever has a locked position, in which the pushing member presses against the abutment face, which causes a portion of the movable stop lever to be pressed against a portion of the housing, such that the movable stop lever is sandwiched between the pushing member and the housing.

In accordance with a non-limiting embodiment of the invention the housing is formed with an opening in which the movable stop lever moves between unlocked and locked positions.

In accordance with a non-limiting embodiment of the invention when the movable stop lever is in the locked position, the pushing member presses against the abutment face, which causes a curved surface of the base member of the movable stop lever to be pressed against an inner housing surface of the housing.

In accordance with a non-limiting embodiment of the invention the firearm attachment member includes a wedge or a protrusion formed on the housing.

In accordance with a non-limiting embodiment of the invention the magazine retention device is coupled to a firearm, and the housing is installed in a rear hollow space formed in a grip, rearward of a magazine well, of the firearm.

BRIEF DESCRIPTION OF DRAWINGS

The present invention will be understood and appreciated more fully from the following detailed description, taken in conjunction with the drawings in which.

DETAILED DESCRIPTION

Figure 1:
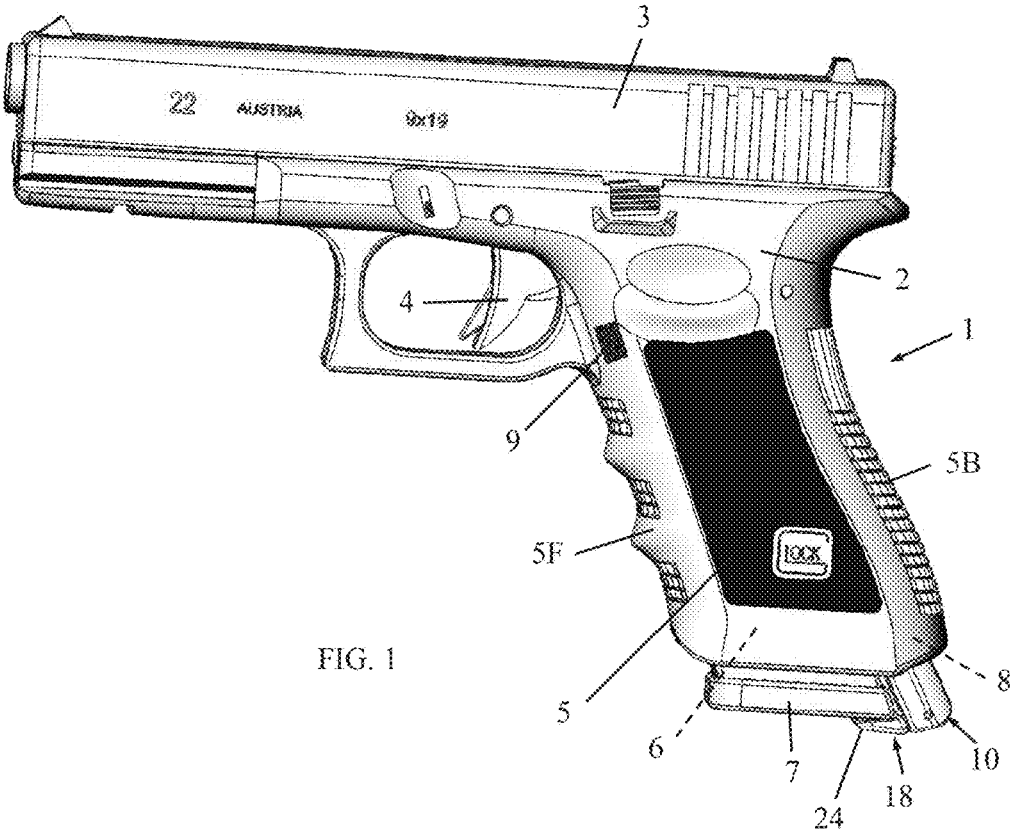
FIG. 1 is a simplified perspective illustration of a firearm including a magazine retention device, in accordance with a non-limiting embodiment of the present invention, with a movable stop lever of the device in a locked position in which it is below and against the floor plate of the magazine.

Reference is now made to FIG. 1, which illustrates a firearm 1 including a magazine retention device 10, in accordance with a non-limiting embodiment of the present invention. The illustrated firearm is a GLOCK 19 handgun, but the invention can be carried out with other GLOCK models, other handguns and rifles.

The firearm 1 has a frame 2, slide 3, trigger 4, and grip 5. The grip 5 has a magazine well 6 for inserting therein a magazine 7. Grip 5 has a front strap 5F and a back strap 5B. A rear hollow space 8 is formed in the grip 5, rearward of the magazine well 6. The rear hollow space 8 is usually left untouched, although a grip frame insert plug is available on the market for closing this space. In the GLOCK handgun, there is an internal wall that separates the magazine well 6 from the rear hollow space 8. A magazine release catch 9 is provided for releasing or ejecting the magazine from the magazine well 6.

Figure 2:
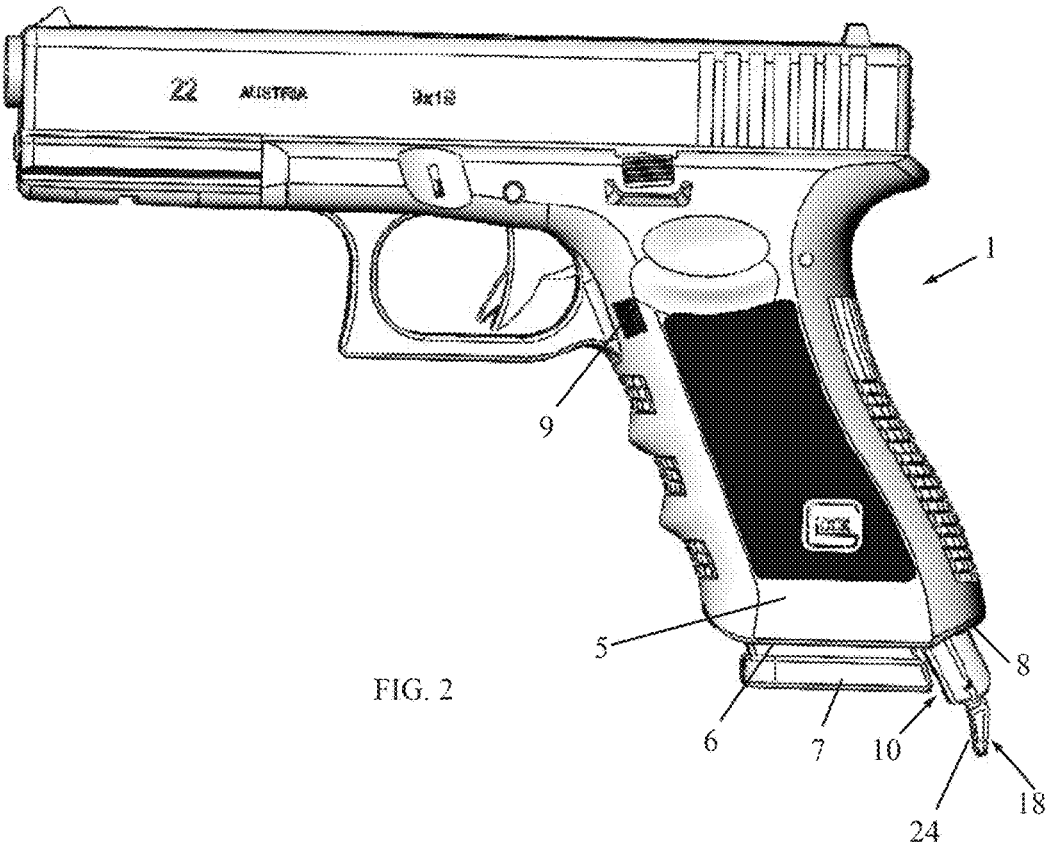
FIG. 2 is a simplified perspective illustration of the firearm and magazine retention device, in which the movable stop lever of the device is in an unlocked position so the magazine can be pulled out of the magazine well.
Figure 3A:
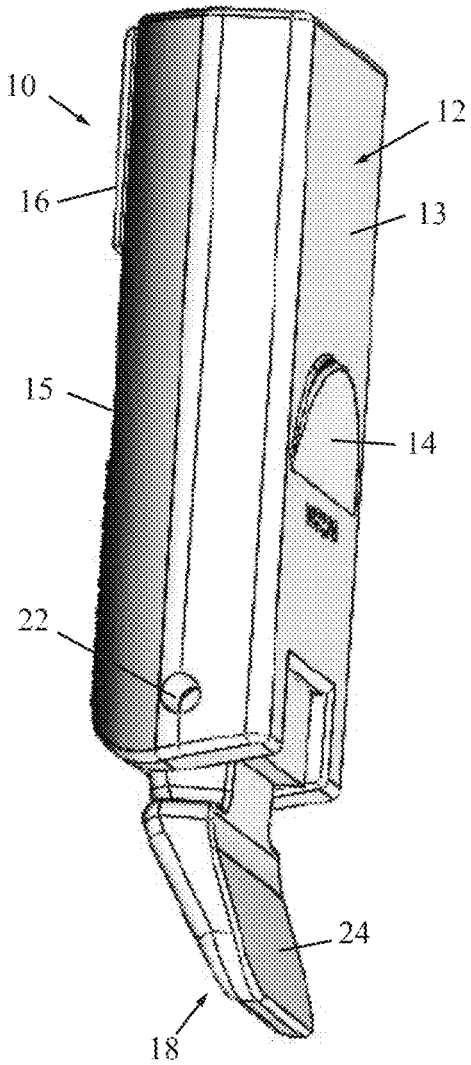
FIGS. 3A and 3B are perspective illustrations of the magazine retention device, with the movable stop lever in unlocked and locked positions, respectively.
Figure 3B:
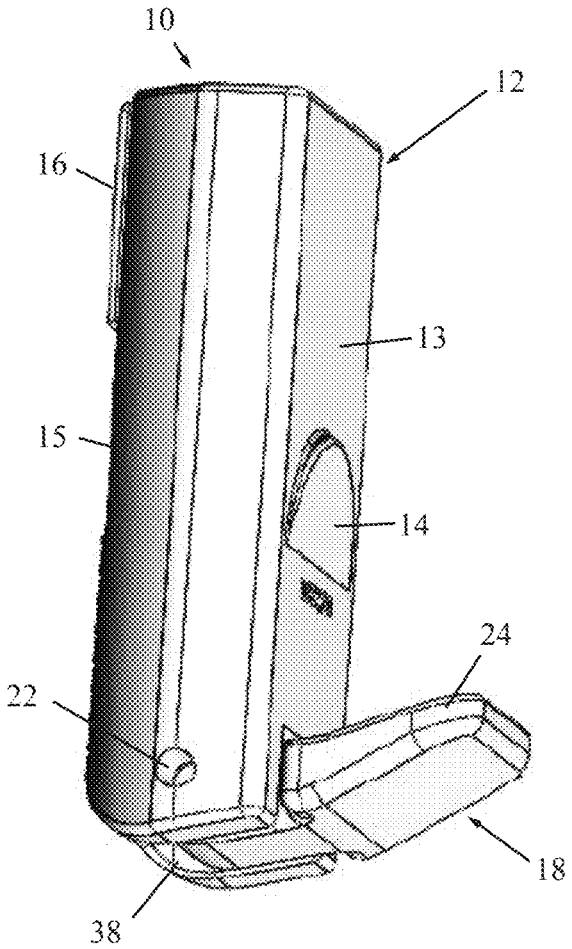

In one version of the invention, as seen in FIGS. 1 and 2, the magazine retention device 10 is installed in the rear hollow space 8. However, the invention is not limited to this installation, and the magazine retention device 10 may be coupled to the grip or other parts of the firearm in other manners.

Reference is now made to FIGS. 3A, 3B, 4, and 5, which illustrate the magazine retention device 10, in accordance with a non-limiting embodiment of the present invention.

Magazine retention device 10 may include a housing 12, made of any suitable rigid material, such as but not limited to, a metal, such as stainless steel, or a polymer, such as polycarbonate, nylon 6/6 or a suitable thermoplastic. The housing 12 has a front surface 13 and a back surface 15, which when installed in the grip of the firearm, respectively face the front strap and back strap of the grip.

The housing 12 has a firearm attachment member for securing the magazine retention device 10 to a portion of a firearm. In one version, the firearm attachment member may be a wedge 14 on the front surface 13 of housing 12 and/or a protrusion 16 on the back surface 15. In this manner, the magazine retention device 10 may be inserted in the rear hollow space 8 of the grip 5 (FIGS. 1 and 2) by a wedged, snug, friction fit inside the rear hollow space 8 and/or by catching onto a recess or groove found in rear hollow space 8.

Alternatively, the firearm attachment member may be another element for coupling the magazine retention device 10 to the grip or other parts of the firearm, such as but not limited to, a fastener (e.g., mounting screw) that secures the magazine retention device 10 to a threaded hole in the grip or other parts of the firearm, or a strap or cord that secures the magazine retention device 10 to the grip or other parts of the firearm.

Figure 4:
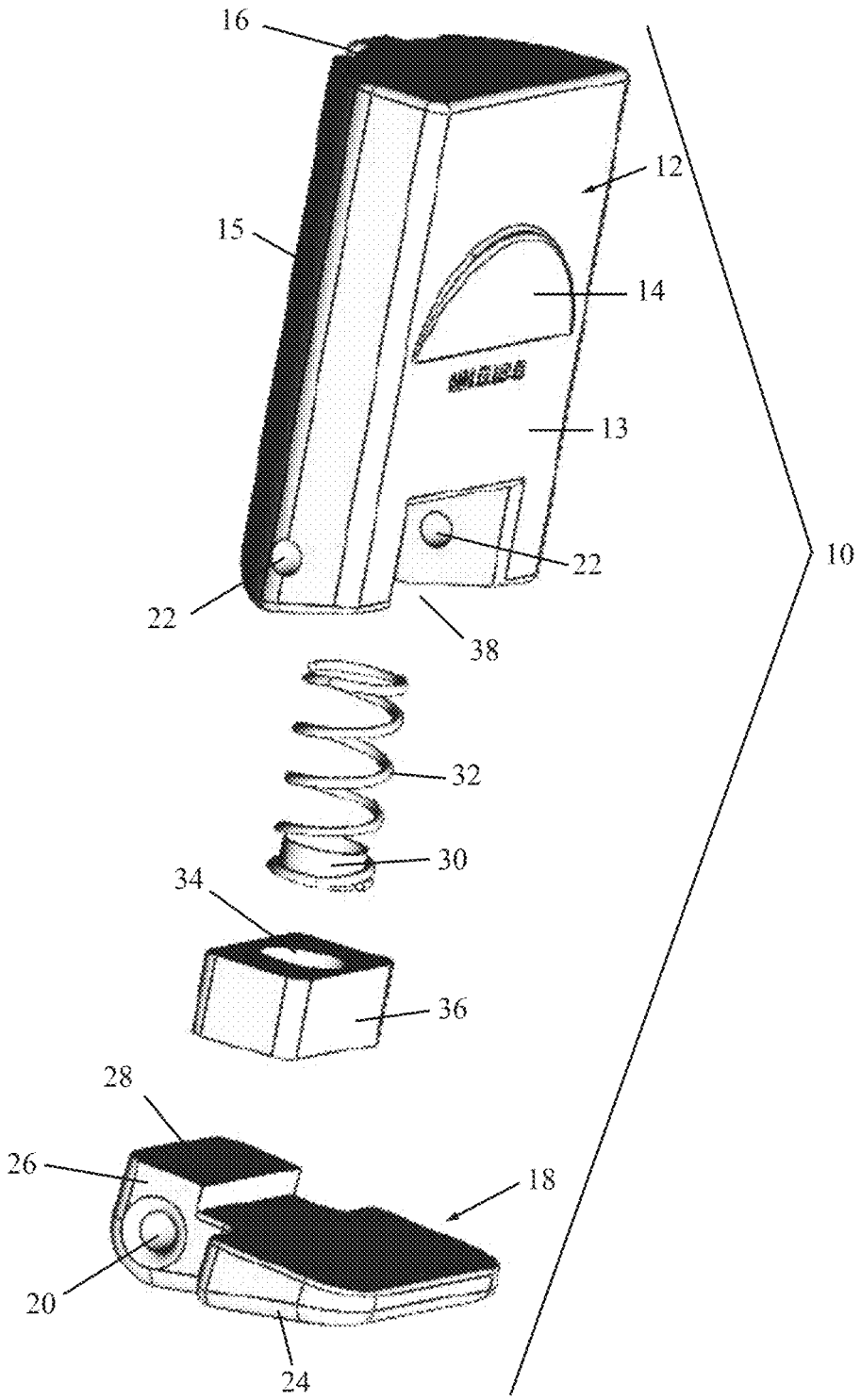
FIG. 4 is an exploded perspective illustrations of the magazine retention device.
Figure 5:
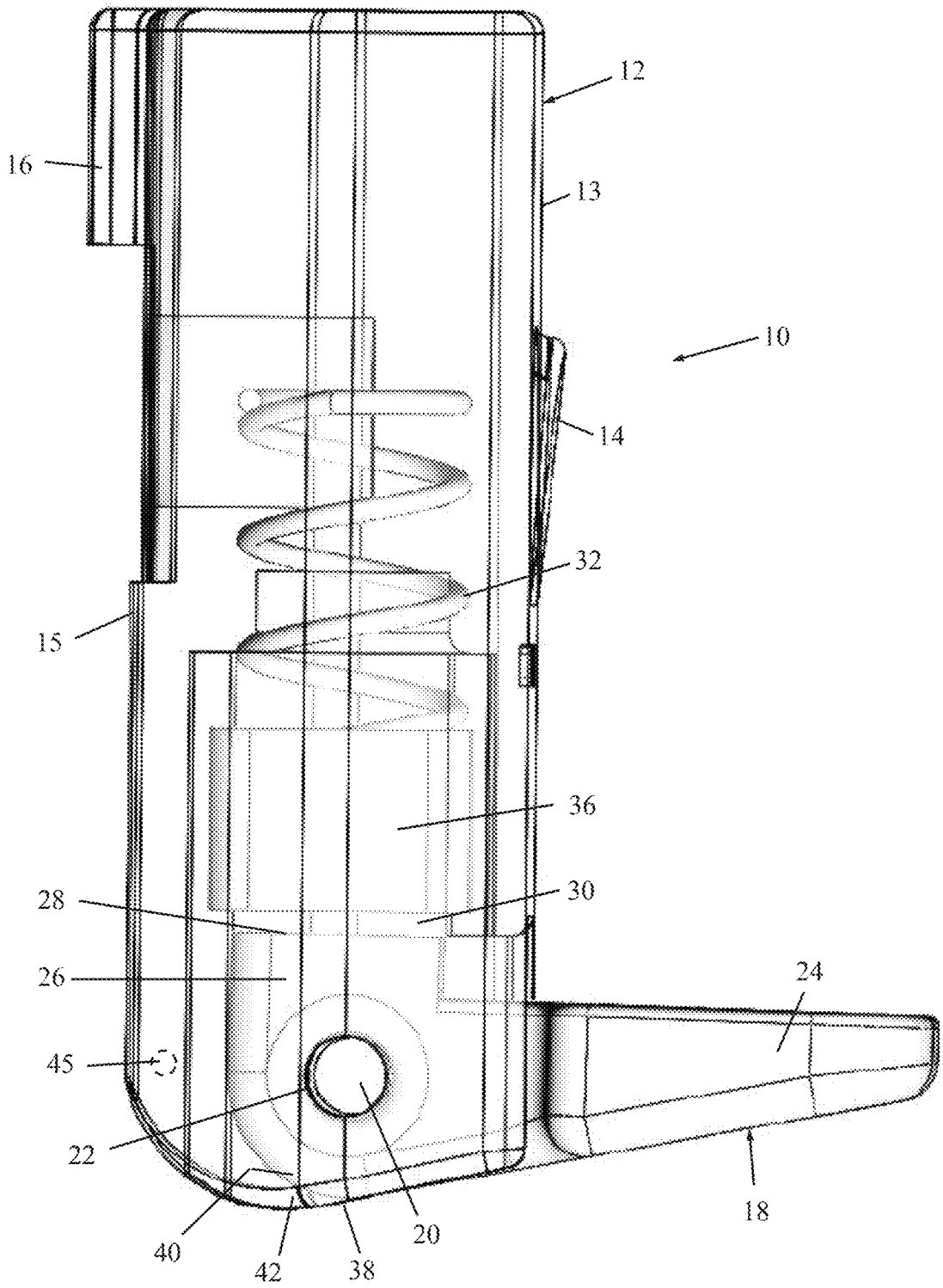
FIG. 5 is a transparent perspective illustration of the magazine retention device in the locked position, showing geometric locking of movable stop lever, in accordance with a non-limiting embodiment of the present invention.

The magazine retention device 10 includes a movable stop lever 18, which may pivot about a pivot 20, such as a pin or round protrusion, received in a mounting hole 22 in housing 12 (FIG. 4; two pivots and two mounting holes are shown in FIG. 4). As seen in FIGS. 4 and 5, movable stop lever 18 may include a tab 24 extending from a base member 26. Base member 26 may have an abutment face 28, which may be flat.

Alternatively, instead of pivoting about a pivot, movable stop lever 18 may be slid (moved in translation) between locked and unlocked positions, or other kinds or combinations of movement.

The magazine retention device 10 may include a pushing member 30 which is urged against abutment face 28 by a biasing device 32, such as a coil spring. The pushing member 30 may be guided through an aperture 34 (FIG. 4) formed in a guide member 36.

Housing 12 is formed with an opening 38, in which movable stop lever 18 moves between unlocked and locked positions (the positions shown in FIGS. 2/3A and 1/3B). As seen in FIG. 5, when the movable stop lever 18 is in the locked position, the pushing member 30 presses against abutment face 28, which causes a portion of movable stop lever 18, such as a curved surface 40 of base member 26, to be pressed against a portion of housing 12, such as an inner housing surface 42 adjacent opening 38. Thus, in the locked position, the movable stop lever 18 is geometrically locked by being sandwiched between pushing member 30 and housing 12. In this locked position, even if the magazine release catch 9 (FIG. 1) is pressed, no amount of shaking will drop the magazine out. In order to release the magazine, the user depresses the magazine release catch, grasps the bottom of the magazine and simply pulls the magazine out. The act of pulling out the magazine, with the magazine release catch depressed, provides a lever force on tab 24, overcoming the force of biasing device 32 and rotating movable stop lever 18 about pivot 20 to the open position of FIG. 2 and FIG. 3A.

As seen in FIG. 5, the magazine retention device 10 may be provided with an optional hole 45 (or security ring) for attaching a lanyard. This may be used instead of the standard lanyard hole in handguns.

The invention claimed is:

1. An accessory for use with a firearm, the firearm having a frame, a slide, a trigger, and a grip, the grip having a magazine well and a hollow space formed in the grip, said accessory comprising:

a magazine retention device insertable into said hollow space and comprising a movable stop lever which has an operative position which blocks a magazine from dropping out of said magazine well, wherein said magazine retention device comprises;

a housing having a front surface and a back surface;

a firearm attachment member for securing the magazine retention device to a portion of the firearm;

wherein said movable stop lever comprises a tab extending from a base member, said base member comprising an abutment face; and a pushing member which is urged against said abutment face by a biasing device;

wherein said movable stop lever has a locked position, in which said pushing member presses against said abutment face, which causes a portion of said movable stop lever to be pressed against a portion of said housing, such that said movable stop lever is sandwiched between said pushing member and said housing.

2. The accessory according to claim 1, wherein said movable stop lever pivots about a pivot.

3. The accessory according to claim 1, wherein said housing is formed with an opening in which said movable stop lever moves between unlocked and locked positions.

4. The accessory according to claim 1, wherein when said movable stop lever is in the locked position, said pushing member presses against said abutment face, which causes a curved surface of said base member of said movable stop lever to be pressed against an inner housing surface of said housing.

5. The accessory according to claim 1, wherein said firearm attachment member comprises a wedge or a protrusion formed on said housing.

6. The accessory according to claim 1, wherein said abutment face is flat.

7. The accessory according to claim 1, wherein said pushing member is guided through an aperture formed in a guide member.

8. The accessory according to claim 1, wherein said pivot comprises a pin or round protrusion on said movable stop lever received in a mounting hole in said housing.

9. The accessory according to claim 1, wherein said magazine retention device has a hole or a ring for attaching a lanyard.

* * * * *